US009739572B2

(12) United States Patent
Kovalev

(10) Patent No.: US 9,739,572 B2
(45) Date of Patent: Aug. 22, 2017

(54) STRUCTURALLY REINFORCED OPTICALLY TRANSPARENT BULLETPROOF PANEL

(71) Applicant: The Florida State University Research Foundation, Inc., Tallahassee, FL (US)

(72) Inventor: Alexey Kovalev, Tallahassee, FL (US)

(73) Assignee: The Florida State University Research Foundation, Inc., Tallahassee, FL (US)

( * ) Notice: Subject to any disclaimer, the term of this patent is extended or adjusted under 35 U.S.C. 154(b) by 0 days.

(21) Appl. No.: 15/289,417

(22) Filed: Oct. 10, 2016

(65) Prior Publication Data

US 2017/0030684 A1 Feb. 2, 2017

Related U.S. Application Data

(60) Division of application No. 14/885,568, filed on Oct. 16, 2015, now Pat. No. 9,494,389, which is a continuation of application No. PCT/US2014/034374, filed on Apr. 16, 2014.

(60) Provisional application No. 61/812,517, filed on Apr. 16, 2013.

(51) Int. Cl.
*F41H 5/26* (2006.01)
*F41H 5/04* (2006.01)

(52) U.S. Cl.
CPC ..... *F41H 5/0407* (2013.01); *F41H 5/26* (2013.01)

(58) Field of Classification Search
CPC ..... F41H 5/0407; F41H 5/263; F41H 5/26; E05G 1/026; E06B 7/082
USPC ..... 89/36.02, 36.14, 36.04; 109/78, 16
See application file for complete search history.

(56) References Cited

U.S. PATENT DOCUMENTS

| | | | |
|---|---|---|---|
| 4,005,662 | A | 2/1977 | Kohn et al. |
| 4,170,947 | A | 10/1979 | Morgan |
| 5,452,641 | A | 9/1995 | Kariya |
| 5,747,170 | A | 5/1998 | Von Alpen et al. |

(Continued)

FOREIGN PATENT DOCUMENTS

| | | |
|---|---|---|
| EP | 0807797 | 11/1997 |

OTHER PUBLICATIONS

International Search Report and Written Opinion dated Aug. 18, 2014 for International Patent Application No. PCT/US2014/034374 with an International filing date of Apr. 16, 2014.

(Continued)

*Primary Examiner* — Michael David
(74) *Attorney, Agent, or Firm* — Andriy Lytvyn; Smith & Hopen, P.A.

(57) ABSTRACT

A structurally reinforced optically transparent panel that may be utilized as a bulletproof window or shield. The panel includes a plurality of angled reinforcement members having a reflective top and bottom surfaces. Optical lenses are disposed between the reinforcement members directing a light ray in a predetermined direction. The geometry and spacing of the reinforcement members is such that the light rays enter and exit the bulletproof panel at substantially the same angle allowing an observer to view optical images of objects behind the bulletproof panel, thus creating optical transparency. The reinforcement members are of a high strength material capable of being impenetrable by a projectile fired from a ballistic weapon or an explosion debris.

7 Claims, 14 Drawing Sheets

(56) References Cited

U.S. PATENT DOCUMENTS

| | | | | |
|---|---|---|---|---|
| 6,014,270 | A | 1/2000 | Bergmann et al. | |
| 6,276,100 | B1 | 8/2001 | Woll et al. | |
| 6,672,195 | B1 | 1/2004 | Plattner | |
| 8,037,802 | B2 | 10/2011 | Ciriscioli et al. | |
| 8,342,074 | B1 | 1/2013 | Sane et al. | |
| 8,833,233 | B2 * | 9/2014 | Kruger | B32B 7/12 89/36.02 |
| 2011/0226122 | A1 | 9/2011 | Ciriscioli et al. | |
| 2016/0040961 | A1 * | 2/2016 | Kovalev | F41H 5/0407 89/36.02 |

OTHER PUBLICATIONS

International Preliminary Report on Patentability dated Oct. 29, 2015 for International Patent Application No. PCT/US2014/034374 with an International filing date of Apr. 16, 2014.

* cited by examiner

STRUCTURALLY REINFORCED OPTICALLY TRANSPARENT BULLETPROOF PANEL

CROSS REFERENCE TO RELATED APPLICATIONS

This application is a divisional of U.S. patent application Ser. No. 14/885,568 entitled "Structurally Reinforced Optically Transparent Bulletproof Panel" filed on Oct. 16, 2015, which is a continuation of PCT Patent Application No. PCT/US2014/034374, filed Apr. 16, 2014, which claims priority to U.S. Provisional Application No. 61/812,517 filed on Apr. 16, 2013, which is herein incorporated by reference.

BACKGROUND OF THE INVENTION

1. Field of the Invention

This invention relates to reinforced structures. Specifically, it relates to a structurally reinforced transparent panel.

2. Brief Description of the Related Art

At the present, most transparent bulletproof windows and walls are made of the multiple layers of two or more types of glass or plastic. Typically, the layers alternate between hard and soft. The hard layer prevents penetration, while the softer layer provides elasticity allowing the bulletproof glass to flex instead of shattering. Such structures are often constructed by sandwiching layers of polycarbonates or thermoplastics between layers of glass.

An example of a bulletproof glass comprising a plurality of silicate glass sheets interconnected by thermoplastic intermediate layers is disclosed in U.S. Pat. No. 5,747,170. Another example of a multi-layer bulletproof glass comprising several laminated glass panes is disclosed in U.S. Pat. No. 6,276,100. Yet another variation of a multi-layer bulletproof glass comprising alternating sheets of acrylic glass and non-external multi-layered plastics film is disclosed in a European Patent No. 0807797. It has been shown that such structures can withstand the impact of the small armor-like guns and even the impact of the standard military light personal weapon from a certain distance. Yet, the hardness and antiballistic properties of such bulletproof glass are limited by a number of factors, the most significant of which is the hardness of the glass. Furthermore, transparency often becomes an issue, especially as the thickness of the glass is increased.

Accordingly, what is needed is an optically transparent panel reinforced with high-strength non-transparent materials, where the transparency is not reduced by increasing the thickness of the bulletproof structure.

SUMMARY OF INVENTION

The longstanding but heretofore unfulfilled need for a structurally reinforced optically transparent panel is now met with a novel and nonobvious invention. The invention allows for integration of high-strength materials, such as steel, titanium, concrete, specialized plastics, etc., into a transparent panel to increase the ability of the panel to withstand the impact of the ballistic and other projectiles. The thickness of the proposed panel is not limited and can be made arbitrarily large with only moderate attenuation in the optical transparency. These panels can provide much better protection without sacrificing transparency.

The transparent panels according to the present invention are ideal for situations where increased strength and a large field of view are required. The invention involves a special combination of optical and constructive elements that provide both strength and transparency. The invention is not limited to optical frequencies and can be used in the full electromagnetic spectrum with any materials and lenses. For example, lenses can be transparent only for the microwave radiation or for only narrow band of the electromagnetic spectrum. The structural elements can be made from any materials, depending on the purpose, including wood, concrete, steel, titanium, rock, plastic, etc.

In an embodiment, the bulletproof panel includes at least two reinforcement members. Each reinforcement member has an anterior portion and a posterior portion. The anterior and posterior portions form an angle. The reinforcement members are in a parallel alignment with each other, wherein the bottom surface of the second reinforcement member faces a top surface of the first reinforcement member.

Reflective layers are disposed on the top surfaces of the bottom surfaces of the reinforcement members. The light rays propagate through the bulletproof panel from the posterior portion to the anterior portion by reflecting between the reflective layers disposed on the top and bottom surfaces of two adjacent reinforcement members. The passage of light rays through the bulletproof panel enables an observer position in front of the bulletproof panel to view an optical image of an object located behind the bulletproof panel.

In an embodiment, an optical lens may be disposed between two adjacent reinforcement members. The optical lens adjusts the travel paths of the light rays. The optical lens may be one of the following: a cylindrical lens, a convex lens, a concave lens, a Fresnel lens, and a combination thereof.

In an embodiment, a set of optical lenses may disposed between posterior portions of the adjacent reinforcement members to direct the light rays toward the first reflective layer at a predetermined incidence angle. A second set of optical lenses may be position between anterior portions of the adjacent reinforcement members to direct the light rays so that orientations of light rays upon exiting the bulletproof panel are substantially same as upon entering. The set of optical lenses may be a converging-converging lens pair or a converging-diverging lens pair.

A dielectric coating may be disposed on the first or the second reflective layers.

The reinforcement members may be made of a material selected from the group consisting of a metal, a metal alloy, a fiber-reinforced polymer, a rock, concrete, wood, and a combination thereof.

The reflective layer is selected from the group consisting of a dielectric mirror, protected aluminum, enhanced aluminum, ultraviolet enhanced aluminum, protected gold, protected silver, polymethyl methacrylate, polyethylene terephthalate, and a combination thereof. The reflective layers may have a flat or a curved surface.

BRIEF DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT

In the following detailed description of the preferred embodiments, reference is made to the accompanying drawings, which form a part hereof, and within which are shown by way of illustration specific embodiments by which the invention may be practiced. It is to be understood that other embodiments may be utilized and structural changes may be made without departing from the scope of the invention.

Figure 1:
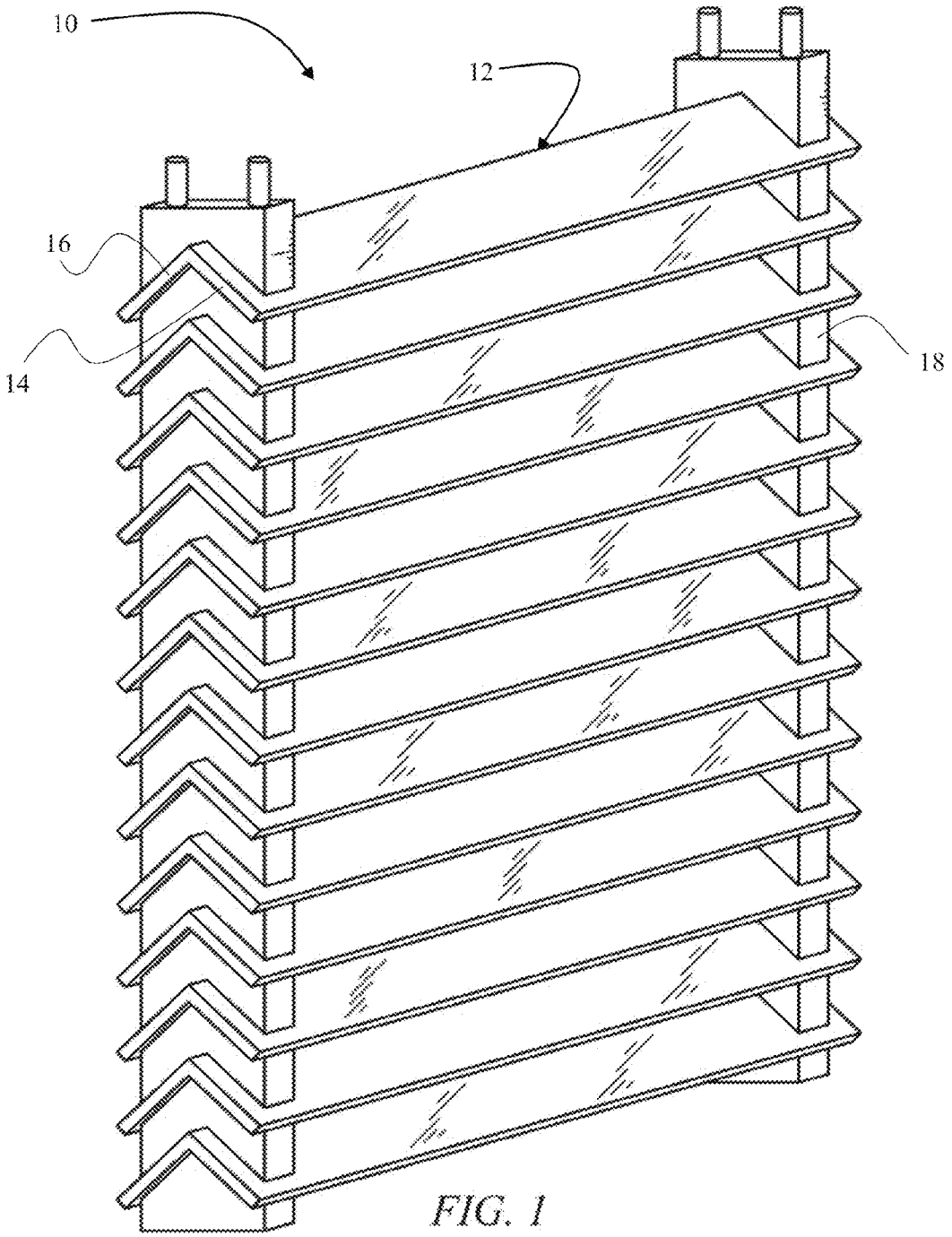
FIG. 1 is a perspective view of the bulletproof panel.
Figure 2:
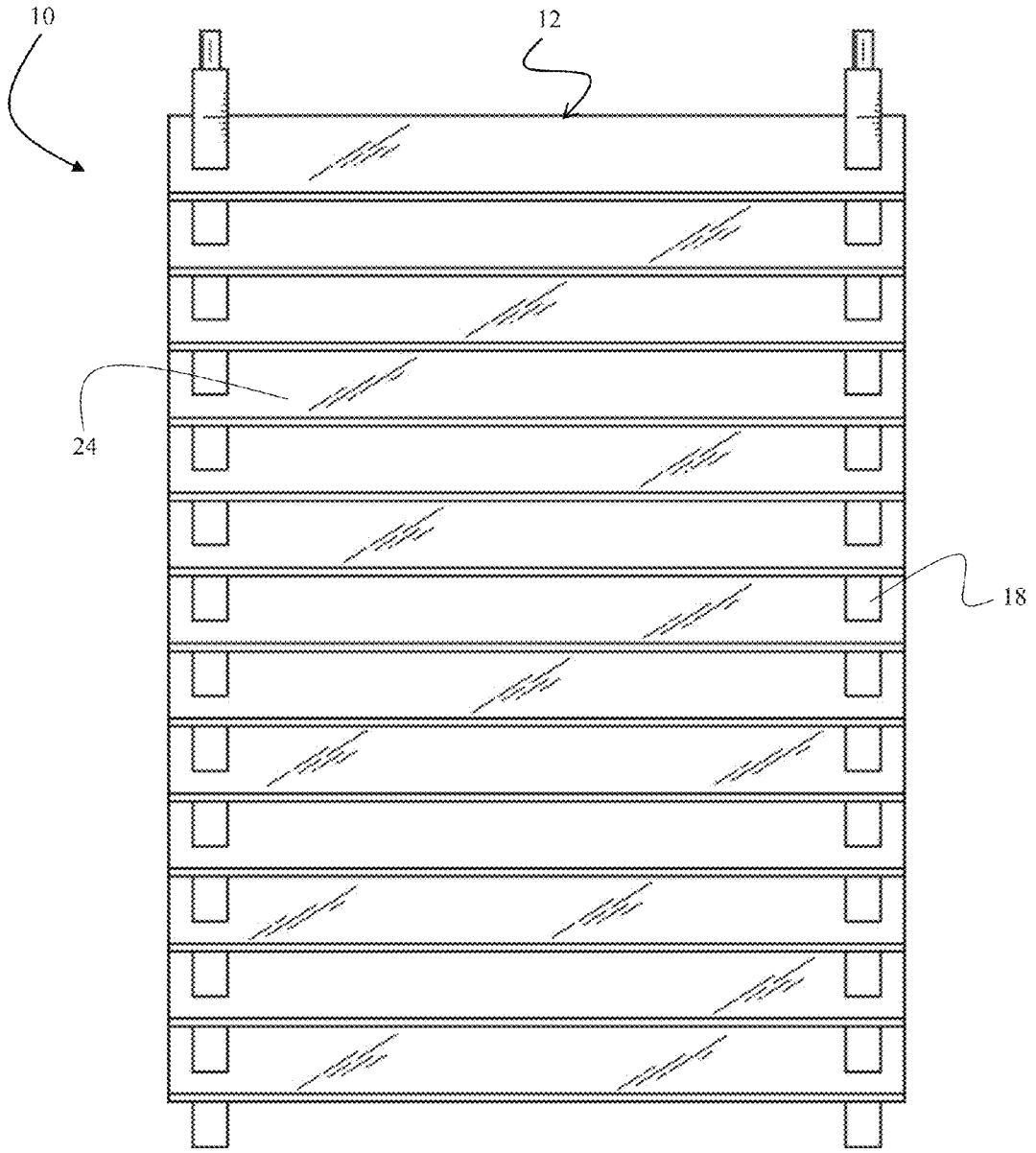
FIG. 2 is a front view of the bulletproof panel.
Figure 3:
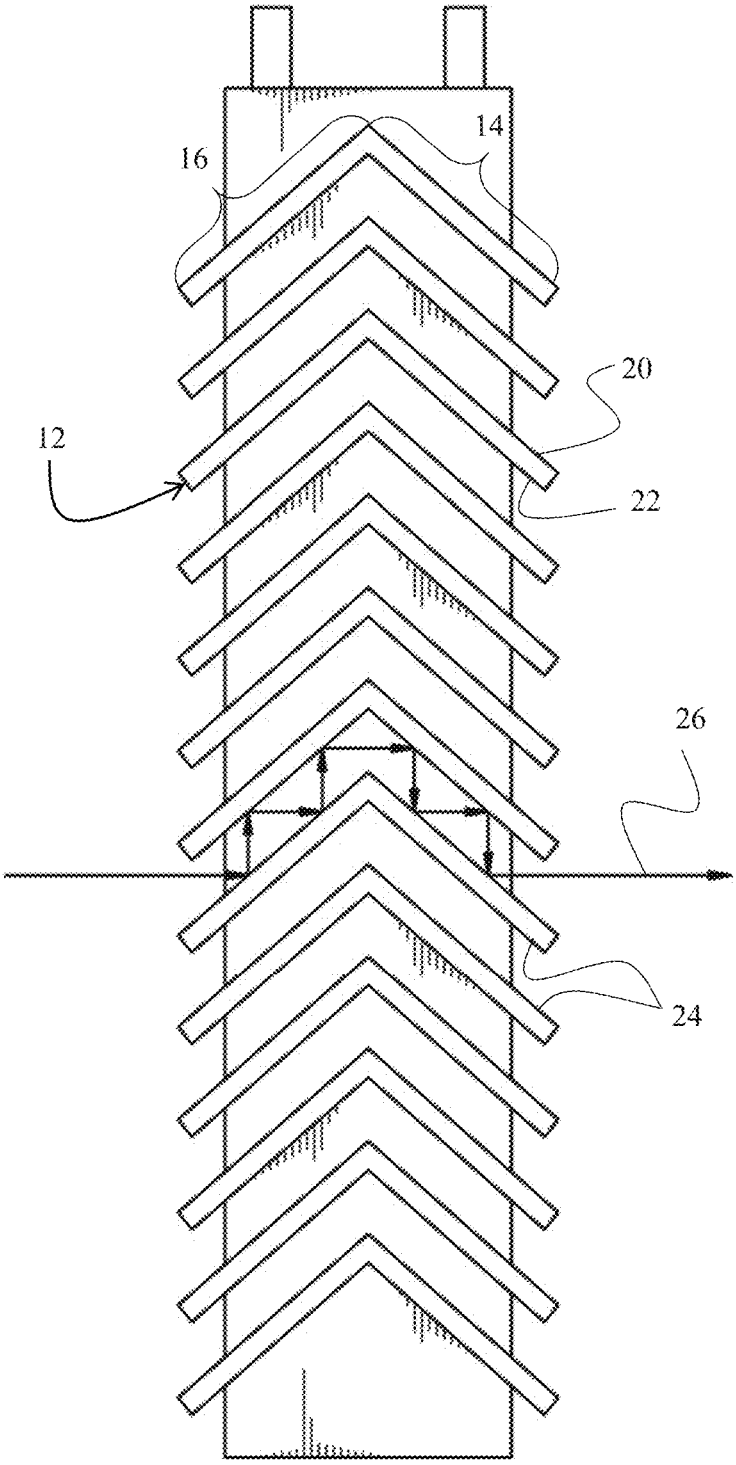
FIG. 3 is a cross-section view of the bulletproof panel depicting an exemplary travel path of a light ray through the bulletproof panel.

An optically transparent bulletproof panel 10 is depicted in FIGS. 1 and 2. Bulletproof panel 10 comprises a plurality of reinforcement members 12. Reinforcement members 12 are in a parallel alignment with each other. Reinforcement members 12 in this embodiment are equidistantly spaced. Each reinforcement member 12 has an anterior portion 14 and a posterior portion 16. The anterior portion 14 and posterior portion 16 form an angle. In the embodiment depicted in FIG. 1, reinforcement members 12 are positioned horizontally and are supported by vertical supports 18. Each reinforcement member 12 has a top surface 20 and a bottom surface 22. Reflective layers 24 are disposed on both surfaces 20 and 22 as shown in FIG. 3.

Figure 4:
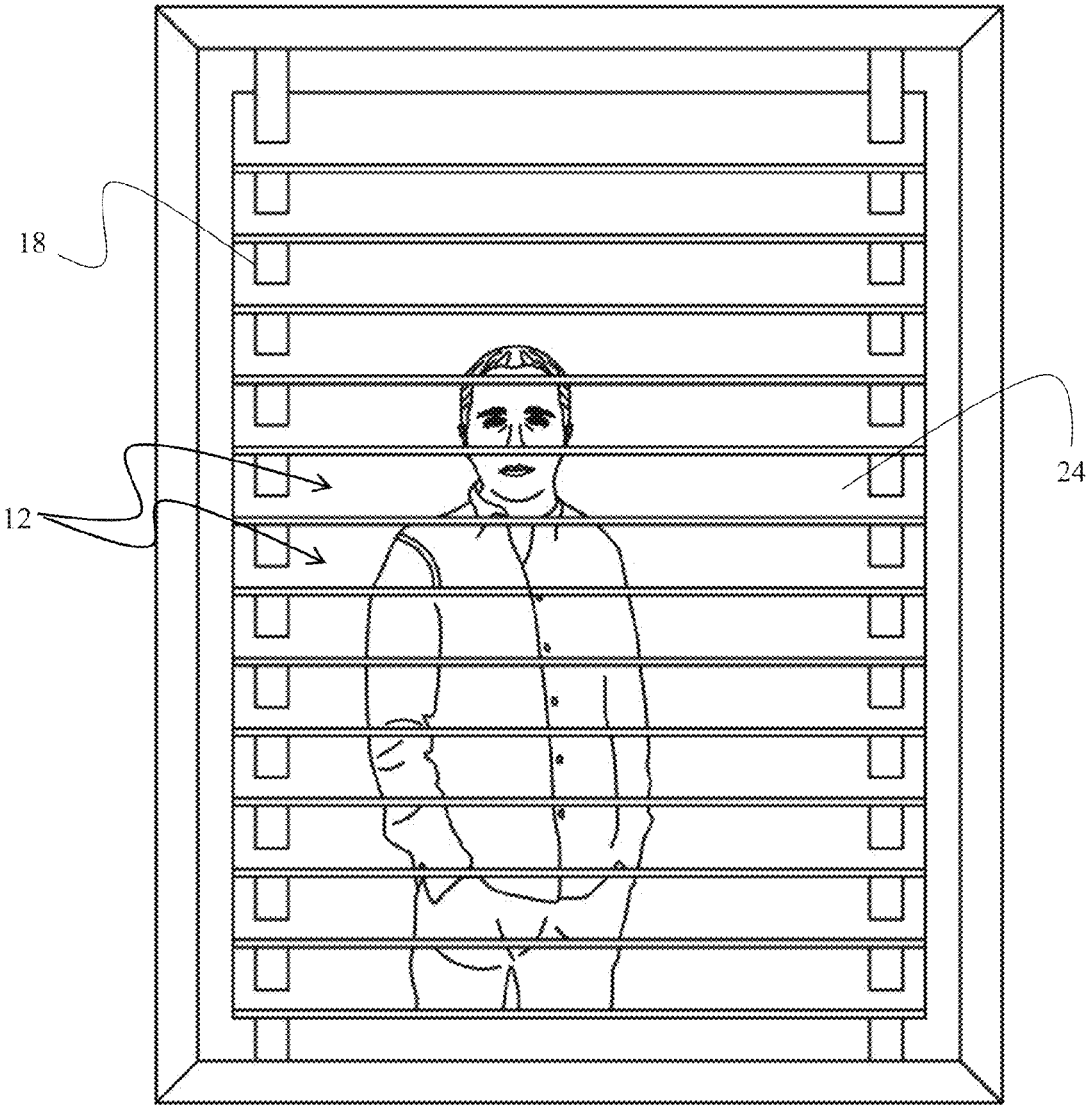
FIG. 4 is a front view of the bulletproof panel depicting an optical image of a human standing behind the bulletproof panel.

Angles between anterior portions 14 and posterior portions 16 of reinforcement members 12 and distances between adjacent reinforcement members 12 are configured to permit a light ray 26 to pass through bulletproof panel 10. An exemplary path of a single light ray 26 is illustrated in FIG. 3. Upon entering the space between two adjacent reinforcement members 12, light ray 26 hits top surface 20 of posterior portion 16 of reinforcement member 12. Light ray 26 is then reflected a predetermined number of times between top surface 20 and bottom surface 22 of two adjacent reinforcement members 12. Light ray 26 exits bulletproof panel 10 by reflecting from top surface 20 of anterior portion 14. Preferably, after making its final reflection of top surface 20 of anterior portion 14, light ray 26 exits bulletproof panel 10 with the same orientation it did at the initial incidence with top surface 20 of the posterior portion 16. This configuration allows an observer standing on one side of bulletproof panel 10 to observe an object located on the opposite side of bulletproof panel 10 as shown in FIG. 4. Accordingly, to the observer, bulletproof panel 10 appears to have optical transparency.

In an alternative embodiment, non-angled reinforcement members 24 may be used. Although this embodiment is simpler than the one depicted in FIG. 3, such bulletproof panel 10 may provide sufficient protection against a projectile traveling in a direct trajectory. However, since there is a number of penetration of trajectories, the protection provided by such embodiment is limited. The image will be also shifted in the vertical or horizontal direction, decreasing the appearance of optical transparency.

Figure 5:
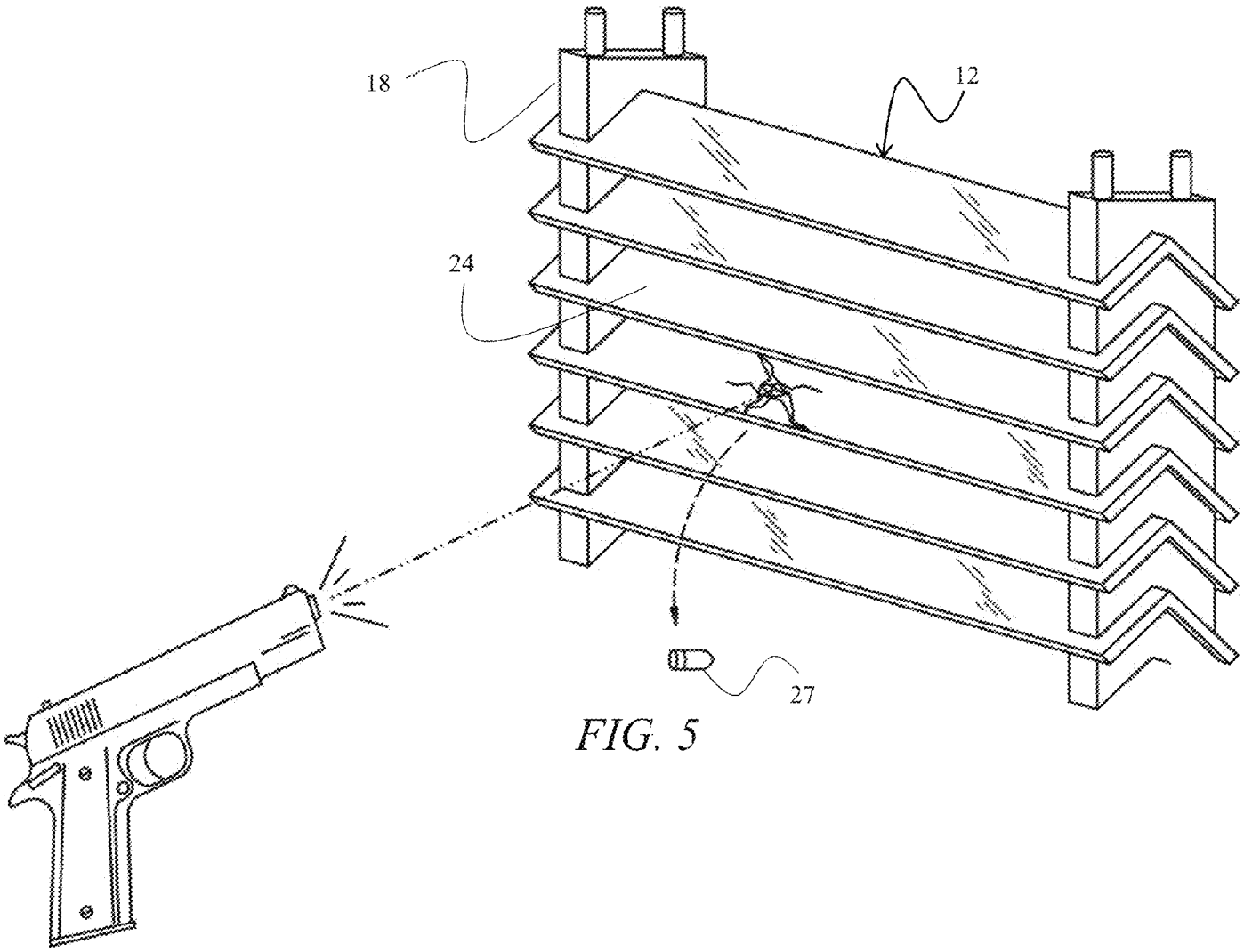
FIG. 5 is a perspective view of the bulletproof panel being struck with and deflecting a projectile.

As shown in FIG. 5, the reinforcement members 12 are shaped and spaced in such a manner that a projectile 27 cannot directly pass through bulletproof panel 10 without first striking at least one reinforcement member 12. For most trajectories, projectile 10 will have to penetrate multiple reinforcement members 12, losing energy upon each incidence. Furthermore, since at most trajectories, the projectile will initially strike reinforcement member 12 at an angle less than 90 degrees, the damaging potential of the projectile will be significantly reduced.

Initial contact of projectile 27 with reinforcement member 12 is critical as it will determine the further projectile behavior. There is an extensive body of both experimental and numerical research regarding the interaction of projectiles with inclined plates. In general, the results of such interactions are following: the projectile penetrates undamaged, penetrates shattered, ricochets, ricochets shattered, or embeds in the target. A particular behavior depends on such factors as projectile speed, its hardness, and hardness of the object being struck. Upon striking an angled surface, the projectile experiences an asymmetric force at the impact, which puts a significant stress on the projectile core.

Bulletproof panel 10 is effective even against armor piercing projectiles. Armor piercing projectiles typically have high hardness enabling them to penetrate through the metal plates. However, when an armor piercing projectile strikes an inclined plane of reinforcement member 12, the projectile's flight path changes towards the normal to the plane, and the projectile experiences a significant bending force. This bending force has a damaging effect on the hard but brittle core of the projectile. Strong asymmetric forces experienced by the projectile upon impact can facilitate fragmentation of the projectile. Accordingly, even if the projectile penetrates bulletproof panel 10, it may nevertheless shatter, thereby substantially reducing or even eliminating the amount of damage the projectile is capable of inflicting.

The reinforced members may be made from a variety of materials exhibiting desired properties, such as high strength, toughness, yield strength, etc. Some examples of materials that could be suitable for some applications include steel, titanium, aluminum, alloys thereof, wood, concrete, plastics, etc. When the bulletproof transparent bulletproof panel 10 is used as a bulletproof window, wall, or shield, the reinforcement members 12 are preferably made of a material that can withstand the impact of the small armor fire and even a small explosion. Moreover, the length and thickness of the reinforcement members 12 may be increased to provide additional structural reinforcement without significant reduction in transparency.

An advantage of the embodiment with horizontally positioned reinforcement members 12 is increased level of transparency throughout the length of the bulletproof panel 10 at a particular height, which may be beneficial since the most important viewing angle is at the eye-level. Furthermore, the distances between reinforcement members 12 may vary depending on their position within the bulletproof panel 10 to provide more accurate images at indirect viewing angles.

In an alternative embodiment, the reinforcement members 12 are positioned vertically. In this embodiment, reinforcement members 12 act as columns and may need to provide sufficient support against compressive forces to which bulletproof panel 10 may be subjected. Bulletproof panel 10 may be used as a bulletproof wall forming a part of a building. In this application, the bulletproof panel 10 may be utilized to reinforce the structural integrity of the building by carrying compressive load applied thereon by the weight of other structural components, such as a roof of the building. Accordingly, it may be preferred that the reinforcement members 12 are oriented vertically so that they can carry the required load without buckling.

The cross-sectional geometry of the reinforcement members 12 is critical and is discussed in more detail in Computer Simulations section below. Although the dimensions and angles may vary, it is crucial that the cross-section of each reinforcement member 12 is such that light ray 26 may be reflected multiple times between two adjacent reinforcement members 12 as depicted in FIG. 3 to achieve optical transparency. The total number of reflections may vary depending on the configuration of reinforcement members 12.

A large variety of materials having appropriate refractive indices may be utilized to create reflective layers 24. Highest possible reflectivity is preferred, as it will allow light ray 26 to travel along the intended path achieving sufficient optical transparency. The typical reflectance for the metallic mirrors ranges from 90% (aluminum) to 96% (silver). The Table 1 shows the typical reflection data for metallic mirrors.

TABLE 1

| Type | Wavelength Range | Reflection |
|---|---|---|
| Protected Aluminum | 400-700 nm | R(ave) >85% |
| Enhanced Aluminum | 450-650 nm | R(ave) >95% |
| UV Enhanced Aluminum | 250-700 nm | R(ave) >85% |
| Protected Gold | 700-800 nm | R(ave) >94% |
| | 800-10 000 nm | R(ave) >97% |
| Protected Silver | 500-800 nm | R(ave) >98% |
| | 2000-10 000 nm | R(ave) >98% |

As evident from Table 1, some types of metallic mirrors have high reflectivity and may be sufficient. However, dielectric mirrors can have reflectance of up to 99%, depending on polarization of light and angle of incidence, and therefore, their performance may depend on the actual geometry of the mirror assembly. Dielectric mirrors may be implemented in some embodiments of the invention. Also, polymethyl methacrylate (acrylic) and polyethylene terephthalate (Mylar) could be used.

The light attenuation depends on the number of reflections. For a mirror with a 90% reflectivity, the light intensity will decrease after four reflections by about 35%, and, after eight reflections, it will decrease by about 57%. This effect may be used to attenuate the parasitic images which may appear after a high number of reflections. On the other hand, for the silver-coated mirrors, the light intensity after eight reflections will decrease by only by about 28%, leading to a conclusion that even moderately expensive mirrors can provide excellent light transmission.

Reflective layers 24 described above are substantially flat. In an alternative embodiment, reflective layers 24 may have a predefined curvature (i.e. a parabolic with a given focus distance) to provide an intentional magnification or diminishing of the image. Reflective layers 24 can be made with a controllable focus length using methods known in the art. Reflective layers 24 can also be shaped in a way that they all have different focal lengths and positions (i.e. focus for all the reflective layers 24 is in the same point in space).

Increased thickness of reinforcement members 12 provides a higher level of structural integrity and protection from projectiles. However, as the thickness of reinforcement members 12 increases, the thickness may partially obstruct visibility, which may result in the bulletproof panel 10 resembling window blinds or a fence where the slats partially obstruct the view as shown in FIG. 4.

Figure 6:
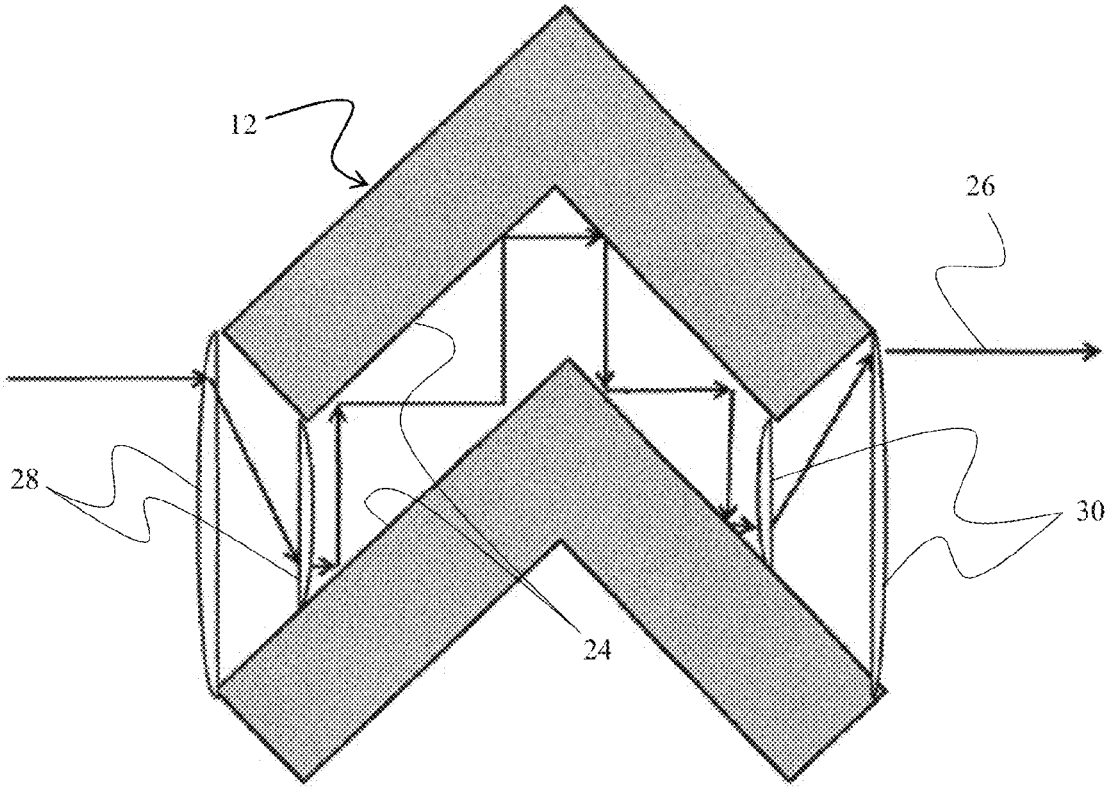
FIG. 6 is a cross-sectional view of an embodiment of the bulletproof panel utilizing optical lenses depicting an exemplary travel path of a light ray through the panel.

A lens arrangement may be added to compensate for thickness of the reinforcement members 12 as shown in FIG. 6. In this embodiment, two sets of optical lenses 28 and 30 are disposed between adjacent reinforcement members 12. Outmost lenses form anterior and posterior surfaces of bulletproof panel 10. The first set of two optical lenses 28 is posited at the point where light ray 26 enters the space between adjacent reinforcement members 12, and a second set of two optical lenses 30 is disposed at the point where light ray 26 exits. First set of lenses 28 is adapted to change the direction of light ray 26 so that when light ray 26 passes through first set of lenses 28, it enters between top surface 20 and bottom surface 22 of two adjacent reinforcement members 12 at an angle that allows light ray 26 to be reflected between surfaces 20 and 22 to propagate toward the second set of lenses 30. Second set of lenses 30 is configured to change the direction of light ray 26 so that it exits the bulletproof panel 10 substantially at the same angle at which it entered. Additional lenses may be used as needed to direct the light according to the desired trajectory. In this manner, the bulletproof panel 10 appears to be optically transparent.

The main purpose of the lens arrangement is to transform an incoming parallel light ray into an outgoing parallel light ray with a smaller width. There are two basic configurations that can accomplish this purpose: converging-converging lens pair and a converging-diverging lens pair. The first configuration is converging-converging lens pair depicted in FIG. 7. If the distance between the lenses is equal to the sum of their focal distances, the final image will be decreased by the ratio of the focal distances and brought closer to the lenses.

Figure 7:
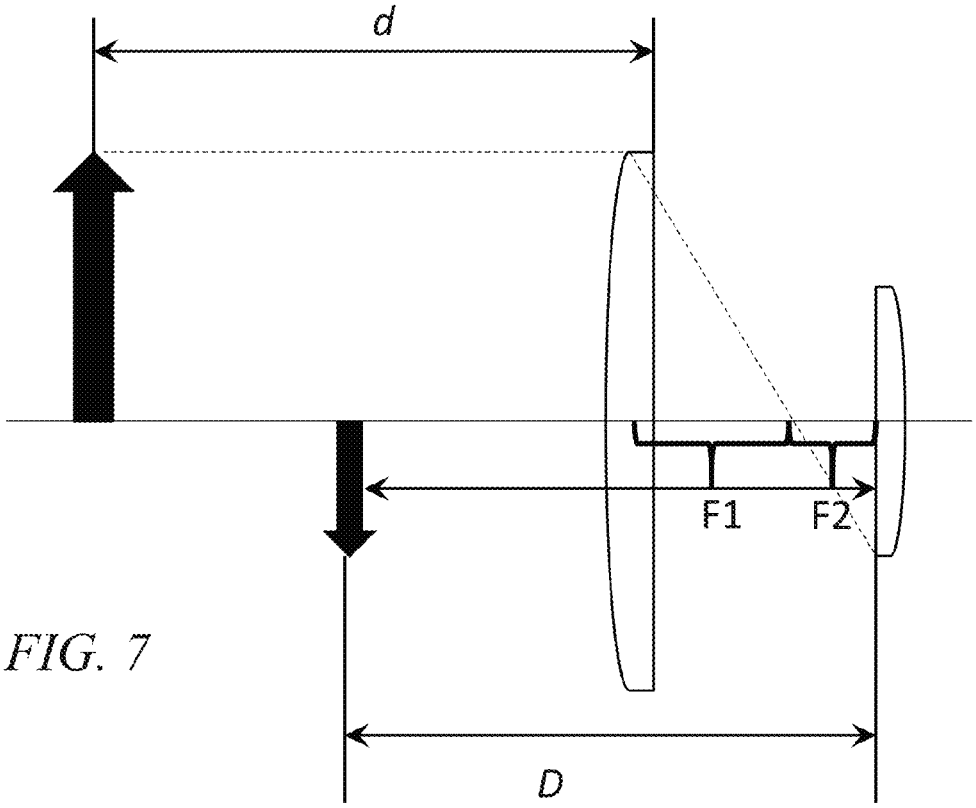
FIG. 7 is a schematic drawing depicting a converging-converging lens pair.

As shown in FIG. 7, after the light ray passes through the first pair of lenses the size of the image is reduced by the ratio of their focal lengths, the image appears closer than the actual object. The distance from the image to the lens can be found by using the equations provided below, where d represents the distance between the object and the first lens, d1 represents the distance between the image created by the first lens and the first lens, and F1 and F2 are focal lengths of the first and the second lens respectively.

$$\frac{1}{d} + \frac{1}{d1} = \frac{1}{F1}$$

If d>>F1, then $$d1 \approx F1 + \frac{F1^2}{d}$$

The first image is now between the focus and the surface of the second lens. This means that the image is virtual and is on the same side as the object. The distance D between the second lens and the second image must satisfy the following equations:

$$\frac{1}{D}+\frac{1}{F2-\frac{F1^2}{d}}=\frac{1}{F2}$$

and $$D\approx\frac{F2\left(F2-\frac{F1^2}{d}\right)}{\frac{F1^2}{d}}=d\frac{F2^2}{F1^2}$$

The same converging-converging lens pair, placed on the opposite side of the light guiding element, will flip the image, scale it back, and push it back. However, the object will look further away since the reflective light guiding surfaces will add an extra shift in the object position which is now magnified by the factor $F2^2/F1^2$.

Figure 8:
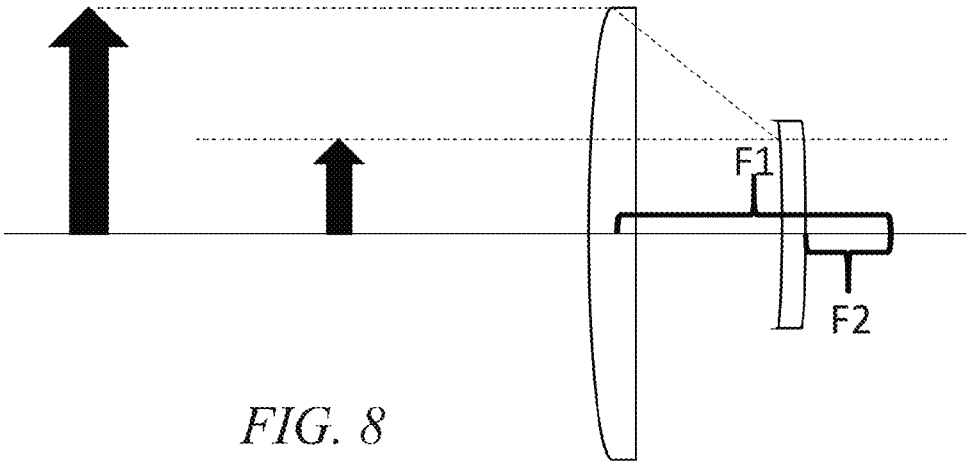
FIG. 8 is a schematic drawing depicting a converging-diverging lens pair.

Another lens configuration is a converging-diverging lens pair shown in FIG. 8. In this configuration, the focus distances and the distance x between lenses are governed by the following expression:

$$F1=F2+x$$

For this structure the scaling factor and the distance to the image is the same as for the first structure, but the image is not inverted.

The preferred embodiment employs cylindrical lenses, i.e. lenses which will have curvature only in one direction. This allows the lenses to be made as elongated structures which run along the reflective light guiding surfaces. The lens pairs can be made as one unit to better control their collective performance.

The above equations govern the ideal lenses. Actual lenses may have some aberrations, including the following: (1) spherical aberrations, due to the fact that lenses are not infinitely thick; (2) chromatic aberrations due to the fact that the focus length may vary for different wavelengths; and (3) image distortion due to deviation of the actual distances between the lenses from the ideal conditions. Spherical aberrations can be corrected by using the special lens shape which avoids the aberrations (aspheric), using the Fresnel lenses, or using the compensation plates. The chromatic aberrations are generally insignificant and can be ignored. The aberrations due to image deviations may distort images at long distances—this issue can be corrected by manufacturing the lens pairs as a single block.

Normal lenses with curvatures in two perpendicular directions can also be used. The conditions for the distance between the lenses and their focal distances remain the same as those discussed above.

At least a pair of lenses must be used on each side of the reinforced structure. However, each lens pair may be made as a single "physical" lens with a convex and a concave surfaces or Fresnel lenses mounted on a single block. The focal distances depend on desired reduction in the width of the light ray, which is controlled by the ratio of focal distances and the amount of available space for mounting the lenses. The most critical parameter of each lens pair assembly is the resulting focal distance. The incoming ray and outgoing rays should be parallel, and, therefore, the focal distance of the assembly should be as large as possible to allow an incoming parallel ray to be converted into an outgoing parallel ray.

In an embodiment, bulletproof panel 10 may be adapted to shield against electromagnetic radiation. This may be accomplished by utilizing the reinforcement members 12 with appropriate dimensions. Essentially, due to the reflective surfaces and the angles at which the light waves are reflected, the reinforcement members 12 function as optically transparent waveguides. The invention is not limited to optical frequencies and can be used in the full electromagnetic spectrum with any materials and lenses. Dimensions and angles of all components are not fixed in absolute or with respect to each other and may be varied to adapt to a specific purpose.

In those embodiments where reflective layers 24 of reinforcement members 12 are metallic (aluminum, silver, gold, etc.), reflective layers 24 can function as parallel plane waveguides. This means the electromagnetic (EM) radiation will pass through bulletproof panel 10 only if its wavelength is smaller than the distance between reflective layers 24 disposed on top surface 20 and bottom surface 22 of two adjacent reinforcement members 12. However, if the distance between two parallel adjacent reflective layers 24 is smaller than the half of wavelength (cut-off wavelength), only the EM radiation with the magnetic field parallel to the mirrors (i.e. transverse mode) will pass.

In some embodiments, reflective layers 24 may have a dielectric coating which is transparent for the light, but has a finite loss at the EM radiation frequency. In those embodiments, the EM radiation can be attenuated due to the losses at reflective layers 24. The light penetrates into the metals at much shorter distances then the EM radiation (<0.01 um vs. ~1.6 um at 2.4 GHz), so thin layer of highly reflecting metal (aluminum, silver, gold, etc. . . . ) over a low conducting material will provide an ideal optical reflection, but rather strong EM attenuation. Attenuation of the EM with certain polarization and frequency (below cut-off frequency or above cut-off length) still has to be taken into account.

Computer Simulations

Several computer simulations were created for the light propagation from a point source through a single element of angled reflective surfaces. Several embodiments of the invention are schematically depicted in FIGS. 9-15. The simulation was done using MATLAB. The simulation assumed a reflection coefficient of 0.9, so the lighter colored lines correspond to the stronger light attenuation. Only light from the source and the light transmitted to the right is shown for clarity.

Figure 9:
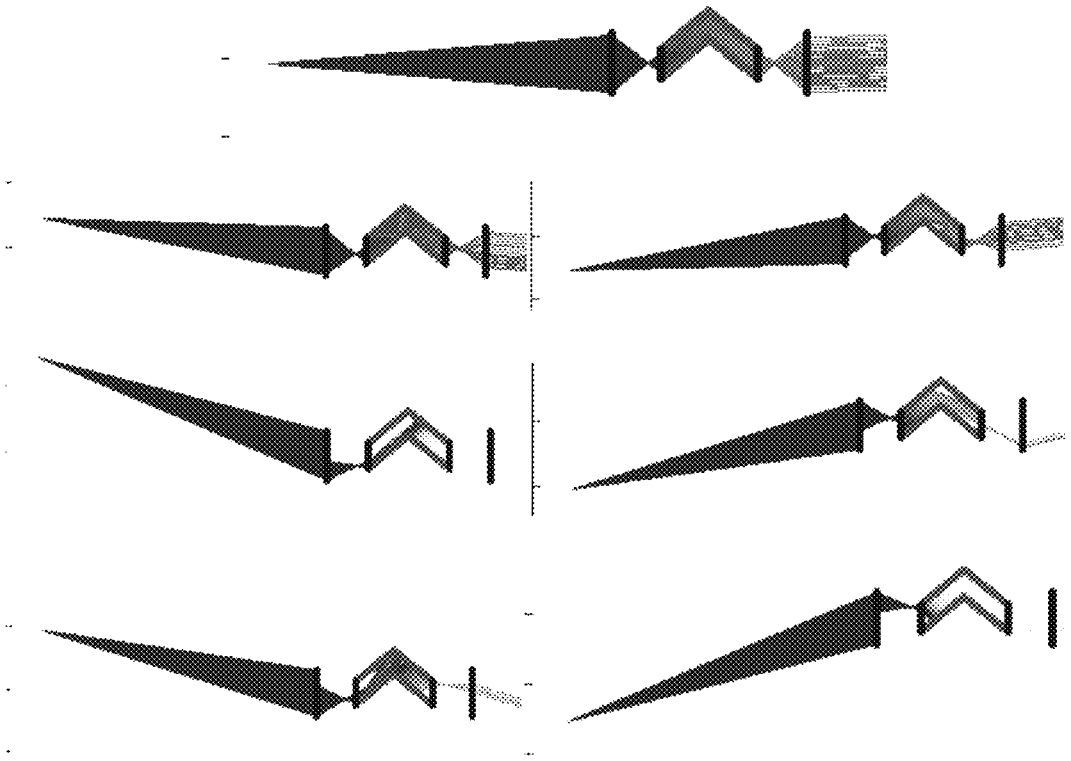
FIG. 9 is a simulation depicting the path of light for an embodiment employing converging-converging lens pairs.
Figure 10:
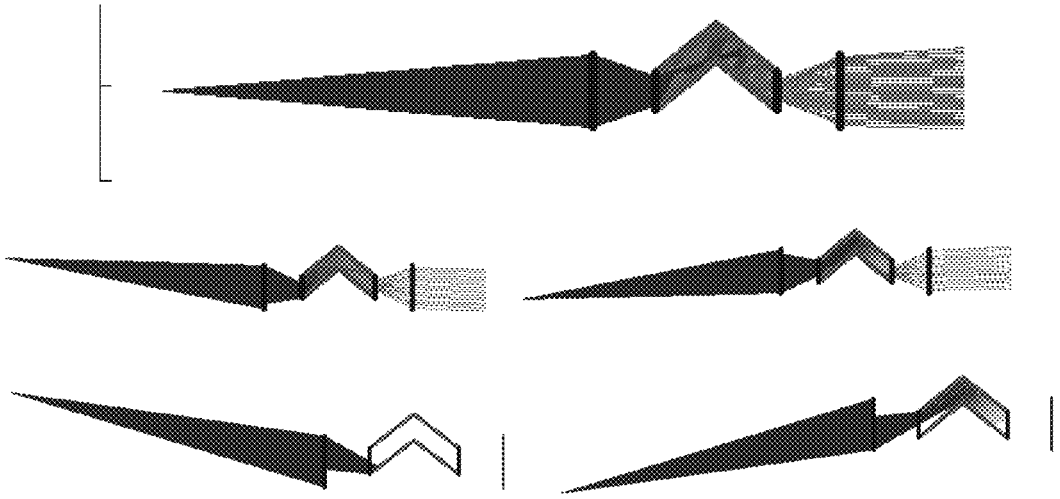
FIG. 10 is a simulation depicting the path of light for an embodiment employing converging-diverging lens pairs.

The simulations depicted in FIGS. 9 and 10 involved the embodiment of the invention having two pairs of optical lenses. FIG. 9 models the embodiment utilizing converging-converging lens pairs, while FIG. 10 models the embodiment utilizing converging-diverging lens pair. As the simulations demonstrated, both embodiments have similar performance for the direct light incidence. The simulations also showed that the converging-converging lens pairs perform better at the oblique incidence than the converging-diverging pairs. The ultimate determination of which pair is employed may depend on the human ability to process the images despite slight distortions.

Figure 11:
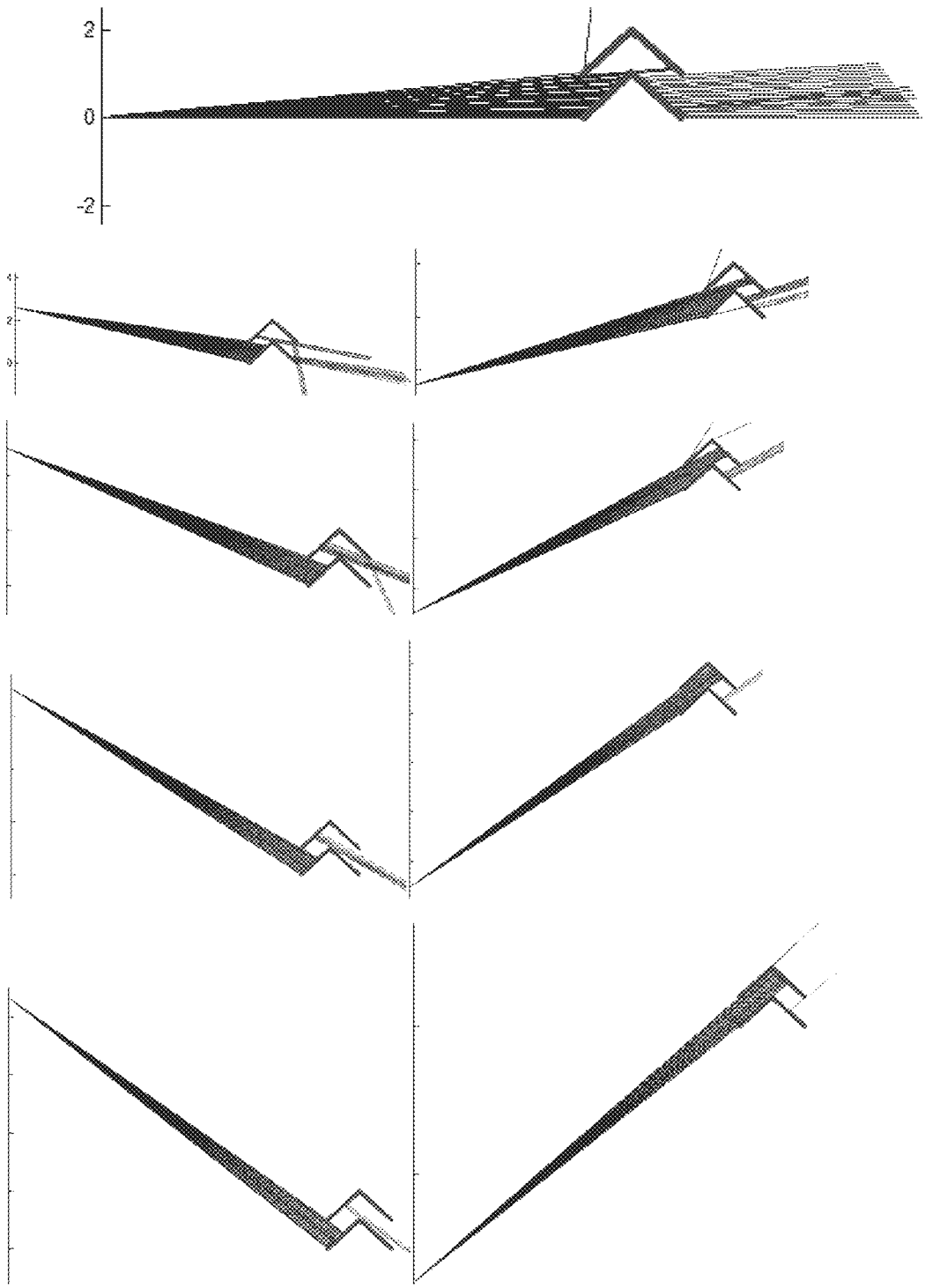
FIG. 11 is a simulation depicting the path of light for an embodiment involving right-angled reinforcement members.

The simulations shown in FIGS. 11-15 do not utilize any corrective lenses. In FIG. 11, the reinforcement members 12 have a right angle; in FIG. 12, the reinforcement members 12 have an obtuse angle; in FIG. 13 the reinforcement members 12 have an acute angle; and in FIG. 14 the reinforcement members 12 have a right angle, but the distance between the adjacent members is half of that of other embodiments. The single spurious rays should be ignored.

Figure 12:
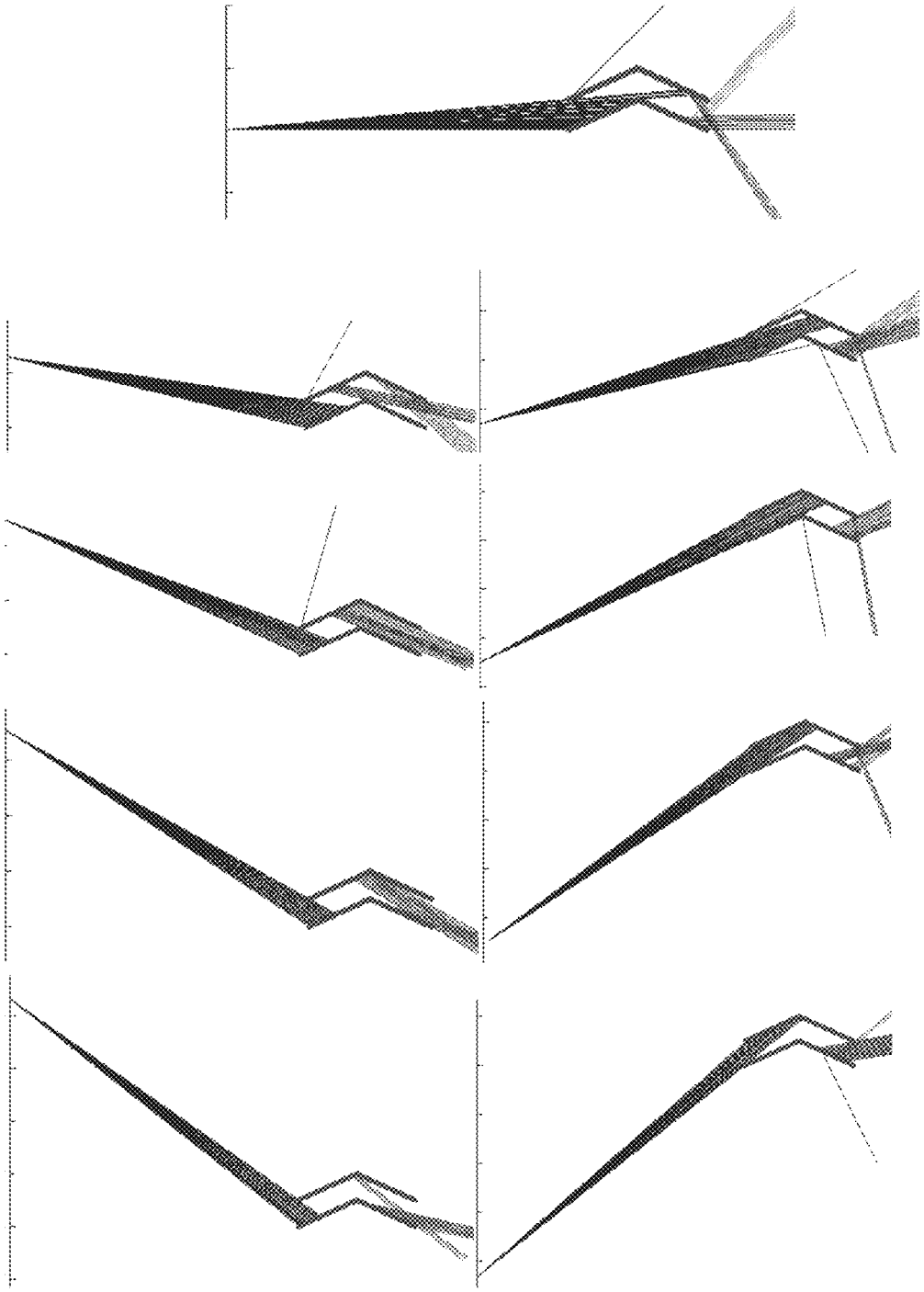
FIG. 12 is a simulation depicting the path of light for an embodiment involving obtuse-angled reinforcement members.
Figure 13:
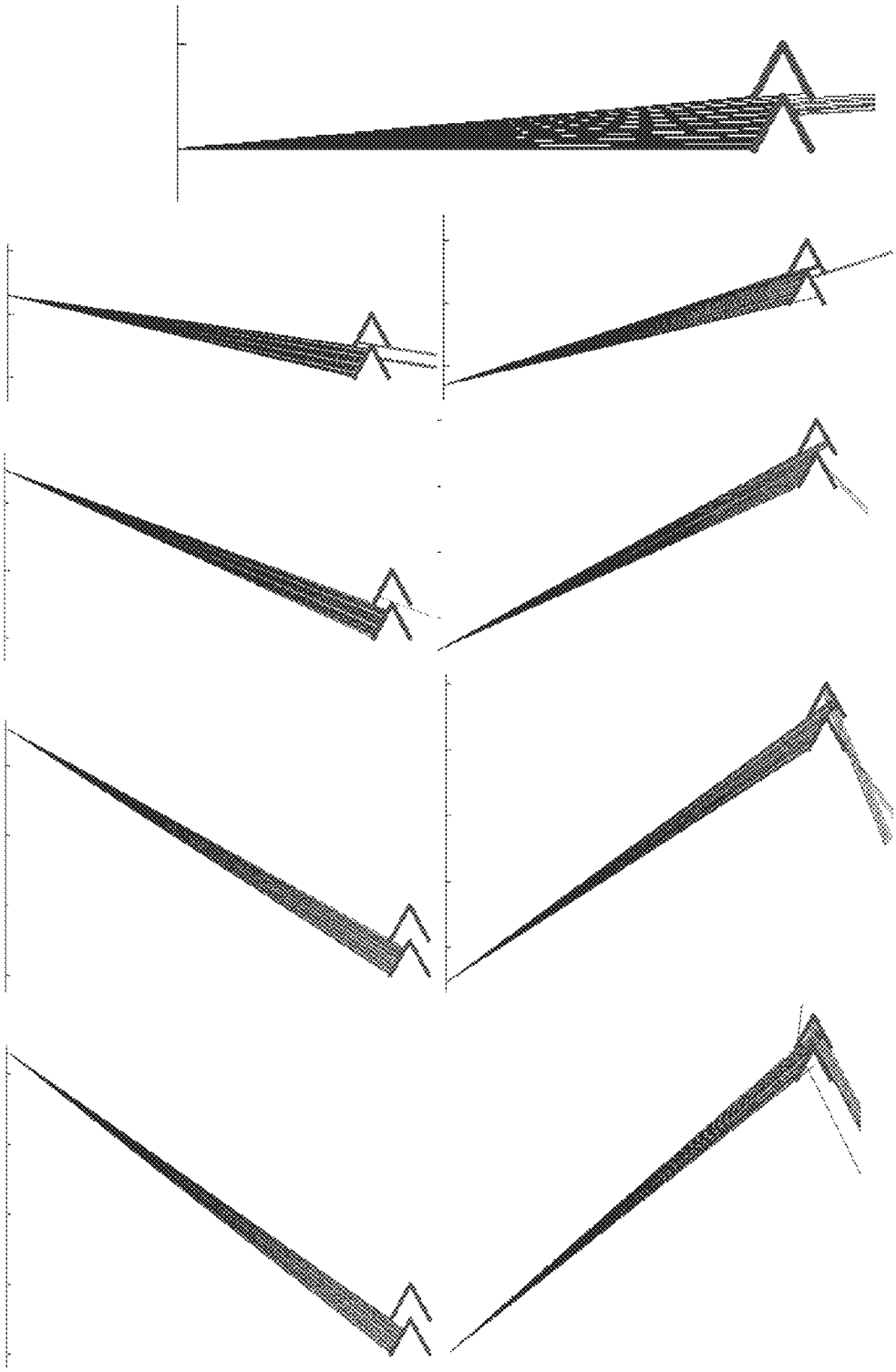
FIG. 13 is a simulation depicting the path of light for an embodiment involving acute-angled reinforcement members.
Figure 14:
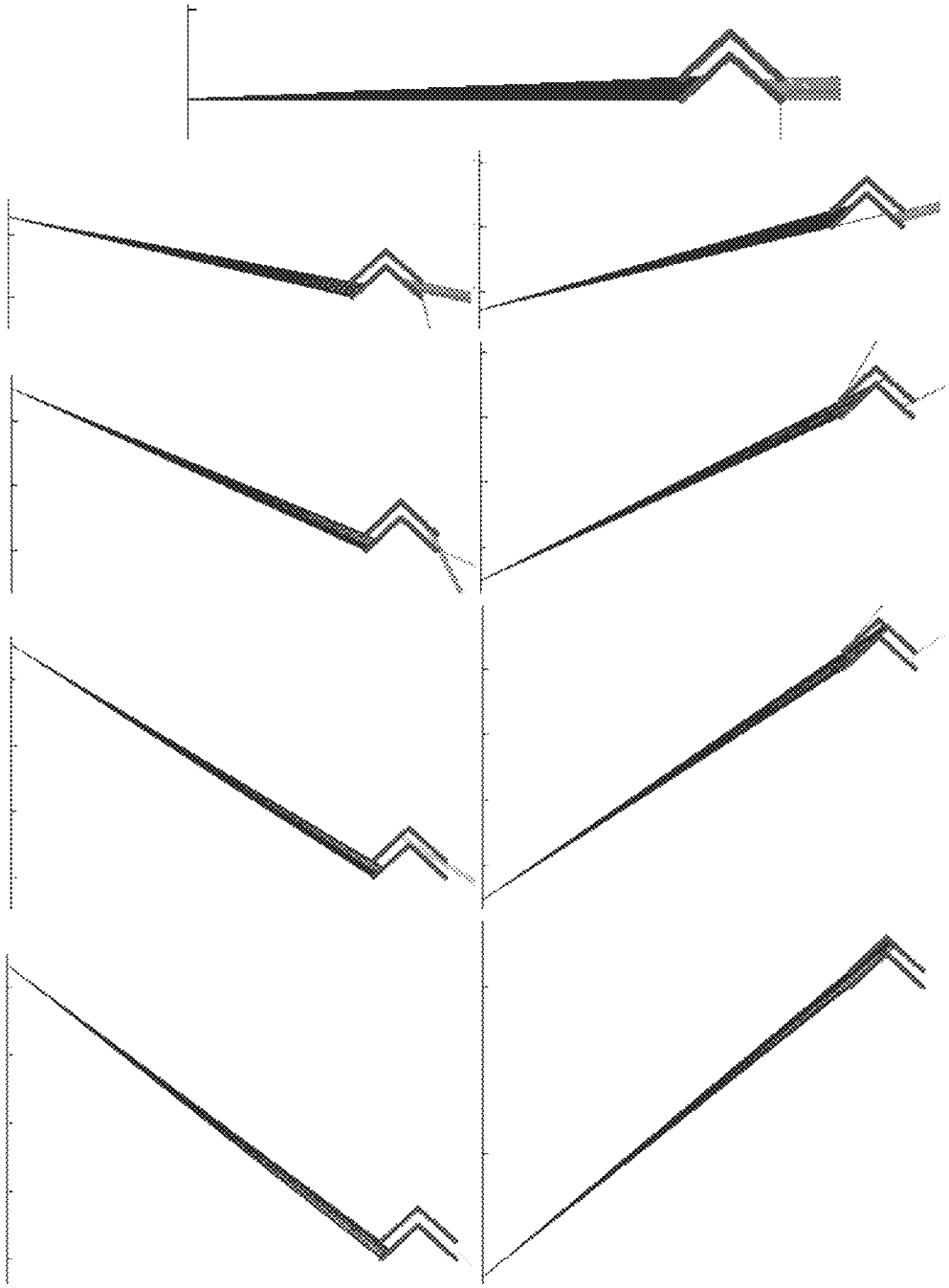
FIG. 14 is a simulation depicting the path of light for an embodiment involving right-angled reinforcement members the distance between which is reduced in half.

As the FIGS. 10-15 illustrate, all embodiments produce some "parasitic" images. The right angled configurations of FIGS. 11 and 14 are about in the middle of the range. At some angles, the reflected light appears as coming from two close positions.

The obtuse angle configuration of FIG. 12 performs much better at the normal incidence, but the source quickly produces several mixing rays if the light is coming from an angle.

The acute angle configuration of FIG. 13 reflects a substantial amount of light back, except in the case when the incoming light is almost parallel to the first pair of reflective surfaces, forming an image in the opposite direction when it comes through. On the other hand, the light coming from steeper angles in a different direction cannot pass the element.

The right angle narrow pass configuration of FIG. 14 performs almost as well as the embodiment of FIG. 10. However, the embodiment of FIG. 14 attenuates the light much stronger because the number of reflections within the element is larger. The reflective surfaces with the reflection coefficient at least 0.95 may be used to improve performance of this embodiment. It is also necessary to take into the account that reflective surface elements will shift the image with respect to the source. FIG. 14 shows the shift for the right angle element. The image after each reflection can be found by reflection of the previous image (starting from the object) against the reflective surface. FIG. 14 shows the main mode for rays positioned close to the center of the overall structure. For other object positions, the shift could vary depending on how the light propagates.

Figure 15:
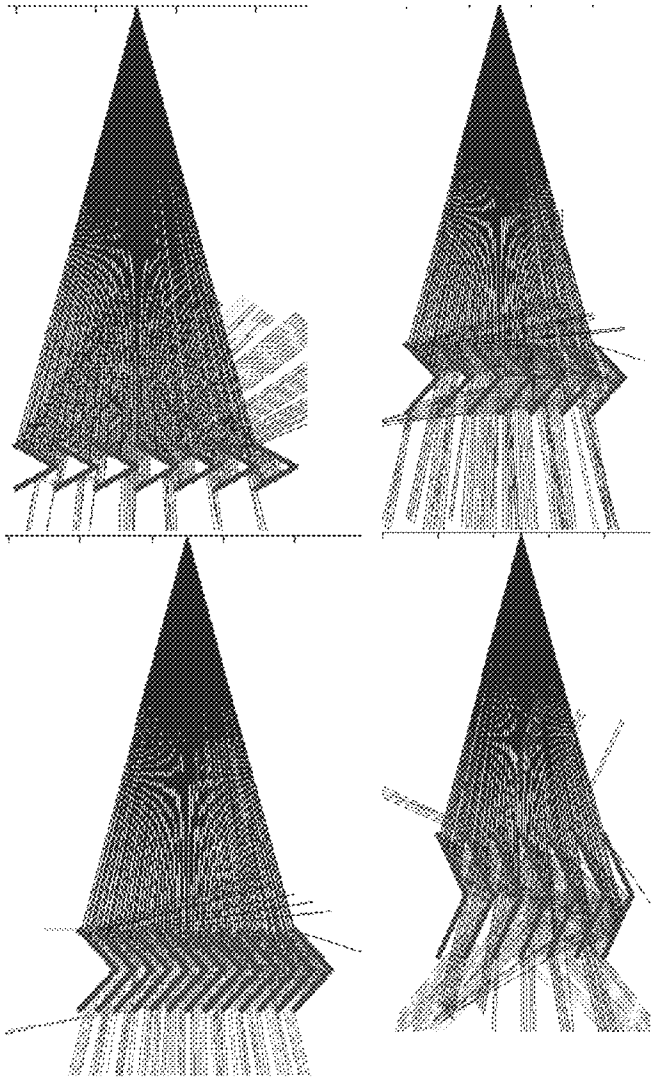
FIG. 15 is a simulation depicting the path of light for different embodiments showing formation of blind spots.

FIG. 15 shows the appearance the "blind" spots for different designs. Generally, at large grazing angles the blind spots are larger. To determine which embodiment is preferred, ability of a human to understand the appearing image, even in the presence of extra reflections, must be taken into account.

EXAMPLE 1

A prototype of bulletproof panel 10 was built and tested. Reinforcement members 12 were made of architectural aluminum (alloy 6063) with a thickness of 2.9 mm±1 mm. Anterior portions 14 and posterior portions 16 had a length of about 50.8 mm and formed 90° angles. The distance between adjacent reinforcement members 12 was about 37 mm. Reflective layer 24 was made of acrylic. Although this prototype did not utilize optical lenses, the optical transparency of the bulletproof panel was satisfactory.

Bulletproof panel 10 was tested by firing a 0.22 and 9 mm caliber rounds. The 0.22 caliber round was stopped by anterior portion 14 of reinforcement member 12. The 9 mm caliber round penetrated anterior portion 14, but was deflected and stopped by posterior portion 16. The successful results of these tests demonstrate that even an inexpensive prototype of bulletproof panel 10 can effectively prevent penetration by a bullet while providing satisfactory transparency. With use of thicker and harder materials for reinforcement member 12 and materials with a higher reflectivity as reflective layers 24, both the ability to stop a projectile and transparency can be improved significantly.

The advantages set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

GLOSSARY OF THE CLAIM TERMS

Angle—a cross-sectional shape of a reinforcing member created between an anterior and posterior portions of the reinforcement member with the vertex being located at a point where the anterior and posterior portions meet. Angle may be formed from a solid piece of material that is bent along a longitudinal axis thereof. The angle may have any curvature radius and any measurement.

Anterior portion—a portion of the reinforcement member at a leading edge thereof; the observer faces the anterior portion, and the light rays exit the bulletproof panel at the anterior portion.

Bottom surface—a surface of the reinforcement member where the anterior and posterior portions form an acute, right, obtuse, or a straight angle.

Bulletproof—designed to resist the penetration of bullets. Bulletproof panel reduces the kinetic energy of a projectile that strikes its surface.

Light ray—an idealized model of light, obtained by choosing a line that is perpendicular to the wavefronts of the actual light, and that points in the direction of energy flow. The term light ray includes incident rays, reflected rays, and refracted rays.

Optical lens—optical component configured to focus, transmit, converge, or diverge light. An optical lens may consist of a single or multiple elements and may have a variety of shapes. Optical lens may refer to a biconvex, plano-convex, positive meniscus, negative meniscus, plano-concave, biconcave, cylindrical, Fresnel, lenticular, gradient index, and axicon lens.

Optical image—the apparent reproduction of an object, formed by a lens or mirror system from reflected, refracted, or diffracted light waves. The optical image may be real or virtual.

Parallel alignment—refers to positioning of reinforcement members with respect to one another. Adjacent reinforcement members in a parallel alignment do not contact each other, and their longitudinal axes are substantially parallel.

Posterior portion—a portion of the reinforcement member at a trailing edge thereof; objects whose optical images are created by the reflective services is position on the posterior side of the bulletproof panel. The light rays enter the bulletproof panel by incidence on the reflective layer on the top surface of the posterior portion.

Reflective layer—a layer of material capable of reflecting light or radiation.

Reinforcement member—an elongated member configured to resist the penetration of bullets or other projectiles. Reinforcement member may have an angular or a non-angular cross-section. Reinforcement member comprises an anterior and a posterior portion, which may be portions of a solid piece of material, or may be joined together via chemical, mechanical, heating, or electric means (i.e. welding, gluing, fasteners, heat fusion, etc.). Top surface—a surface of the reinforcement member where the anterior and posterior portions form a reflex angle.

What is claimed is:

1. A bulletproof panel, comprising:

a plurality of reinforcement members in a parallel alignment, each reinforcement member having a top surface, a bottom surface, a leading edge, and a trailing edge;

reflective layers disposed on the top and the bottom surfaces of the reinforcement members; and a plurality of optical lenses disposed between adjacent reinforcement members, the plurality of optical lenses configured to direct light rays in a predetermined direction at a predetermined angle;

wherein the light rays pass through the bulletproof panel by propagating from the trailing edge to the leading edge by reflecting between the top and the bottom surfaces of the adjacent reinforcement members, thereby creating an optical image of an object located behind the bulletproof panel.

2. The bulletproof panel according to claim 1, wherein each lens of the plurality of optical lenses is selected from the group consisting of a cylindrical lens, a convex lens, a concave lens, a Fresnel lens, and a combination thereof.

3. The bulletproof panel according to claim 1, further comprising a dielectric coating disposed on the reflective layers.

4. The bulletproof panel according to claim 1, further comprising reinforcement members being made of a material selected from the group consisting of a metal, a metal alloy, a fiber-reinforced polymer, a rock, concrete, wood, and a combination thereof.

5. The bulletproof panel according to claim 1, wherein the reflective layers are selected from the group consisting of a dielectric mirror, protected aluminum, enhanced aluminum, ultraviolet enhanced aluminum, protected gold, protected silver, polymethyl methacrylate, polyethylene terephthalate, and a combination thereof.

6. The bulletproof panel according to claim 1, wherein the reinforcement members are equidistantly spaced.

7. The bulletproof panel according to claim 1, wherein the reflective layers have flat or curved surfaces.

* * * * *